United States Patent [19]

Dopkowski

[11] 4,340,227

[45] Jul. 20, 1982

[54] GOLF CLUB SET AND CARRYING CASE

[75] Inventor: William J. Dopkowski, Brighton, Mich.

[73] Assignee: B.P.A. Enterprises, Inc., Detroit, Mich.

[21] Appl. No.: 211,691

[22] Filed: Dec. 1, 1980

[51] Int. Cl.[3] ..... A63B 53/02; A63B 55/00

[52] U.S. Cl. ..... 273/77 R; 273/80.1; 150/1.5 R

[58] Field of Search ..... 273/77 R, 77 A, 80 R, 273/80 D, 80.1, 80.2, 80.7; 150/1.5 R, 52 G; 224/274, 916, 918, 919

[56] References Cited

U.S. PATENT DOCUMENTS

| | | | |
|---|---|---|---|
| 1,951,158 | 3/1934 | Locke et al. | 150/1.5 R |
| 2,256,521 | 9/1941 | Kirkpatrick et al. | 150/1.5 R |
| 2,763,309 | 9/1956 | Jones | 150/1.5 R |
| 2,767,758 | 10/1956 | Itaynes | 150/1.5 R X |
| 2,860,679 | 11/1958 | Kouke | 150/1.5 R |
| 2,879,819 | 3/1959 | Turnbull | 150/1.5 R |
| 3,848,737 | 11/1974 | Kenon | 273/77 R X |
| 3,891,212 | 6/1975 | Hill | 273/77 R X |
| 3,941,398 | 3/1976 | Nelson | 150/1.5 R X |
| 4,021,038 | 5/1977 | Kettleson | 273/80.1 |
| 4,136,724 | 1/1979 | Leitzel | 273/32 E X |
| 4,182,391 | 1/1980 | Kjose | 150/1.5 R |
| 4,253,666 | 3/1981 | Murphy | 273/80.1 |

FOREIGN PATENT DOCUMENTS

| | | | |
|---|---|---|---|
| 2310400 | 9/1974 | Fed. Rep. of Germany | 273/80.1 |
| 1150136 | 4/1969 | United Kingdom | 273/80 R |

OTHER PUBLICATIONS

"Good Golf Sales: Catalog", Mar. 1947.

*Primary Examiner*—Richard J. Apley
*Attorney, Agent, or Firm*—Barnes, Kisselle, Raisch & Choate

[57] ABSTRACT

A golf club set comprising a plurality of differing club heads with individual alphanumeric designations and each having an attached shank of predetermined length differing in correspondence with the differing alphanumeric designations of the club heads, a handle including a shaft of predetermined fixed length, and complementary threaded members carried by the shaft and the several club head shanks for releasably attaching the club heads individually to the handle. In a golf club set of predetermined dexterity, either left-handed or right-handed, the angle of twist of the threaded member is opposite to such dexterity such that the threaded members are self-locking in use. The club set also includes a bag with accessory-carrying pouch and adjustable shoulder strap.

6 Claims, 7 Drawing Figures

FIG. 3
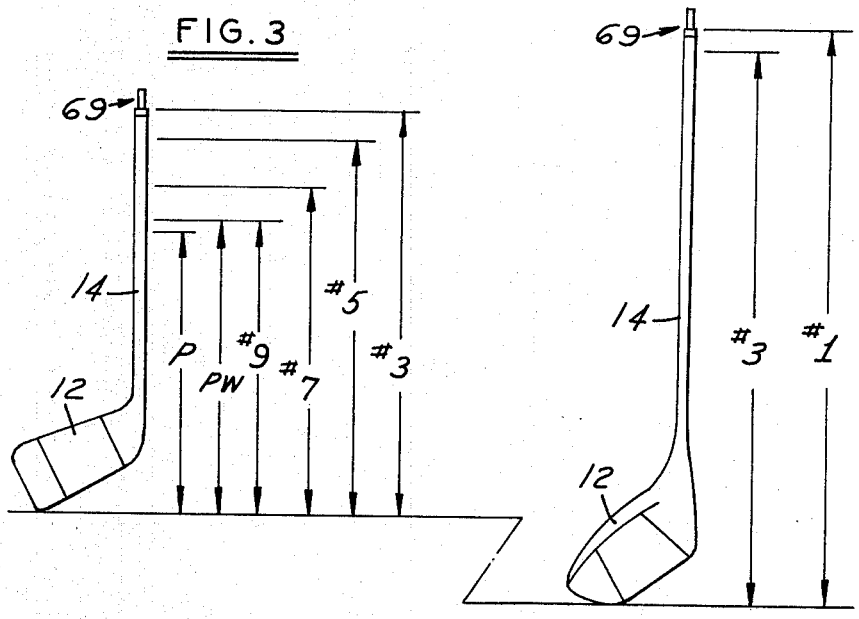
FIG. 6
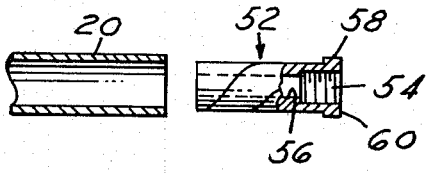
FIG. 7
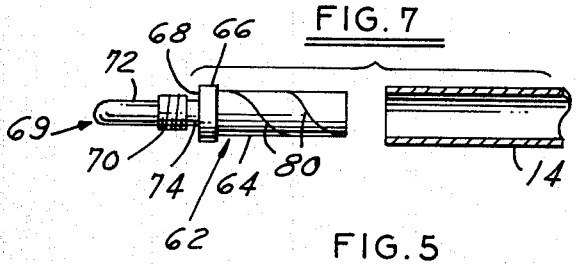
FIG. 5
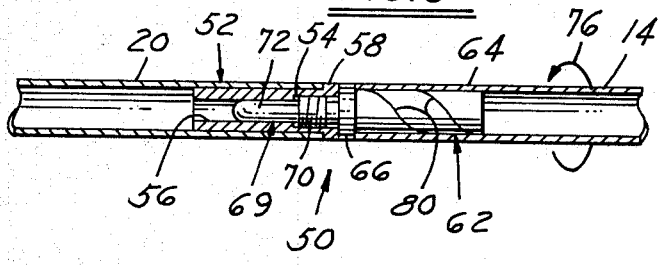
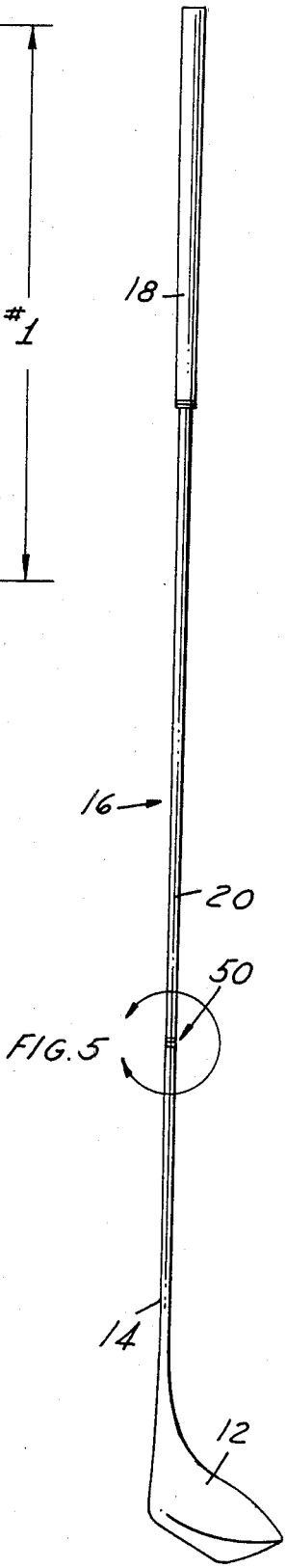
FIG. 4

GOLF CLUB SET AND CARRYING CASE

The present invention is directed to golf club sets of the type comprising a plurality of club heads and a shaft for selectively removably receiving the individual club heads.

Golf club sets of the above-described type have been proposed previously. Two examples of such sets are shown in U.S. Pat. Nos. 3,829,092 and 3,848,737. In prior art golf club sets of the subject type of which the referenced disclosures are typical, a plurality of club heads are provided with attached shanks for removable connection to a single handle, with all of the club head shanks being of identical length. As a result, all of the assembled golf clubs, whether a driver, pitching wedge, putter or three-iron, for example, are of identical length. Additionally, the devices for attaching the several heads to the handle in accordance with the prior art is often complex, expensive and not self-locking in assembly. Moreover, the handle in U.S. Pat. No. 3,829,092, for example, comprises a collapsible telescoping assembly which does not exhibit the desirable strength and flexibility characteristics of one-piece tempered steel shafts.

A general object of the present invention is to provide a golf club set of the type comprising a plurality of differing club heads and a single shaft, which set overcomes the aforementioned and other deficiencies characteristic of the prior art. More specifically, an object of the present invention is to provide a golf club set of the described type wherein the length of each golf club when assembled varies in the usual manner as a function of club type, i.e. wood or iron, and as a function of alphanumeric designation, i.e. three-iron, five-iron or pitching wedge, etc.

Another object of the invention is to provide a golf club set of the described type wherein the coupling device between the club head and shaft is self-locking in operation and may be readily assembled by persons of limited dexterity.

A further object of the invention is to provide a complete golf club set including a carrying case or bag which is inexpensive and rugged, and which may be readily carried by golf enthusiasts of all ages and sexes on the fairway and in travel, as on an airplane for example.

The invention, together with additional objects, features and advantages thereof, will be best understood from the following description, the appended claims and the accompanying drawings in which:

FIG. 3 is a side elevational view of a wood club head and an iron club head, and illustrates the varying dimension of the head and attached shank in accordance with the invention;

FIG. 4 is an elevational view of an assembled club head and handle in accordance with the invention;

FIG. 5 is a sectional view on an enlarged scale of the portion of FIG. 4 encompassed by the line 5—5; and FIGS. 6 and 7 are exploded sectional views of respective portions of FIG. 5.

Figure 1:
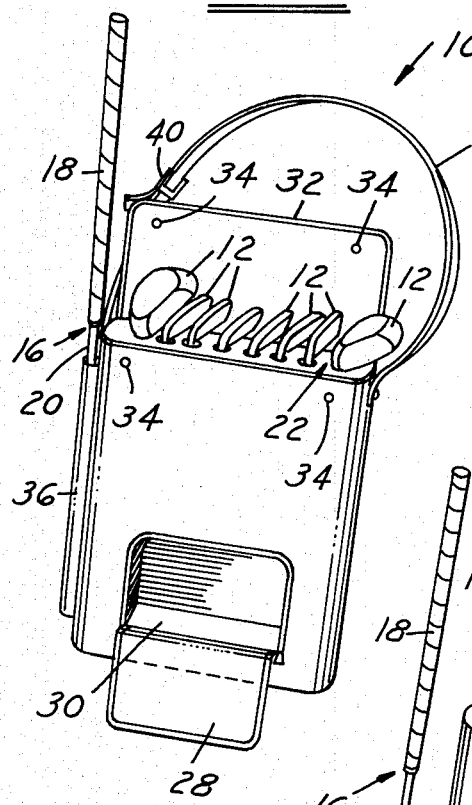
FIG. 1 is a perspective view of a presently preferred embodiment of the golf club set and carrying case in accordance with the invention.
Figure 2:
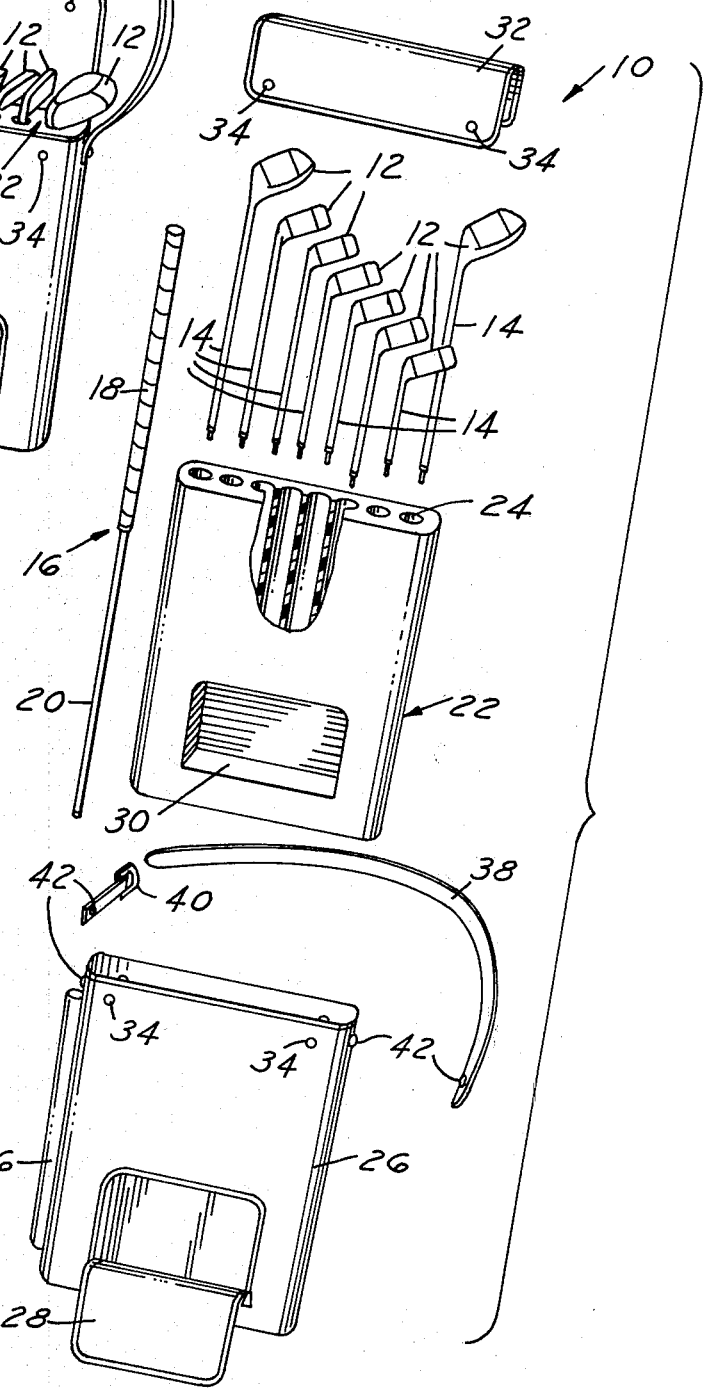
FIG. 2 is an exploded perspective view of the golf club set illustrated in FIG. 1.

Referring to FIGS. 1 and 2, a presently preferred embodiment 10 of the golf club set in accordance with the invention is illustrated therein as comprising a plurality of club heads 12 each having a hollow shank 14 attached thereto and extending therefrom. Shanks 14 may be formed integrally with club heads 12 in a casting operation, for example, or more typically may be formed separately of hollow tubular tempered steel and rigidly attached to the corresponding club heads. Set 10 also includes a handle 16 consisting essentially of a grip 18 of suitable non-slip material and a stepped one-piece hollow steel shaft 20 extending from grip 18 to a predetermined and fixed length. A generally rectangular insert 22 of foam rubber, for example, has a plurality of blind tubular openings 24 extending downwardly therethrough on parallel coplanar laterally spaced axes for receiving the respective shanks 14 such that the various club heads 12 rest on the upper surface of insert 22 in a laterally spaced array best seen in FIG. 1. Insert 22 is removably received into the open end of a case or bag 26 of washable material such as naugahyde, for example.

A zippered flap 28 in a side wall of case 26 selectively opens to afford access to a blind pouch or pocket 30 formed in the side wall of insert 22 for carrying golf accessories such as tees and balls, etc. A cover 32 is removably fastened as by the snaps 34 at the upper edge of both side walls of case 26 so as to retain the club heads 12 within insert 22 when attached during travel, etc, and to be readily removable during use on the fairways. A tubular holster or pouch 36 extends lengthwise along one end wall of case 26 for removably receiving the shaft 20 of handle 16 with grip 18 projecting outwardly as best seen in FIG. 1. A shoulder strap 38 including an adjustment buckle 40 is removably mounted to the end walls of case 26 by the snaps 42.

As is well known in the art, golf clubs, both irons and woods, are conventionally individually characterized by an alphanumeric designation which indicates both the angle of attack of the club face and the club length. In accordance with an important feature of the present invention best illustrated in FIG. 3, the length of each shank 14 attached to and extending from each club head 12, for both woods and irons, varies in length in correspondence with the alphanumeric designation of the associated club head. Thus, the shank 14 for the one-wood or driver is longer than the shank for the three-wood or spoon. Similarly, the length of shank 14 decreases in length for the successive iron numbers three, five, seven and nine. The length PW of shank 14 for the pitching wedge is the same as that for the nine-iron. The shank length P for the putter is slightly less than that for the pitching wedge and nine iron. Thus, when a given club head is assembled to the handle 16 as shown in FIG. 4, the overall length of the head and handle assembly varies with alphanumeric club head designation in the usual and conventional manner as with typical golf clubs wherein the club head and handle are provided as one unit.

A fastening or coupling lock 50 (FIGS. 4 and 5) is provided for releasably attaching each of golf club heads 12 individually to handle 16. In accordance with another important feature of the invention, lock 50 comprises complementary threaded connection members mounted on handle 16 and on each of the shanks 14, the threaded members having a direction of thread twist opposite to the predetermined dexterity, i.e. either left-handed or right-handed, of the golf club set. More specifically, lock 50 comprises an internally threaded female insert 52 (FIGS. 5 and 6) press-fitted and rigidly adhered internally of the grip-remote end of handle shaft 20. Insert 52 includes an axial bore comprising a first threaded portion 54 adjacent to the open end of insert 52 and shaft 20, and an unthreaded portion 56 of reduced diameter extending coaxially inwardly therefrom. A shoulder 58 radiates from the outer end of insert threaded portion 54 and abuts the circular grip-remote edge of shaft 20. Shoulder 58 has a flat face 60 (FIG. 6) on a plane perpendicular to the axis of insert 52 and shaft 20.

Lock 50 also includes a male insert 62 (FIGS. 5 and 7) having a cylindrical body 64 press-fitted and rigidly adhered internally of the head-remote end of each club head shank 14. A shoulder 66 radiates from the outer end of body 64 and abuts the circular head-remote edge of shank 14. Shoulder 66 terminates in a flat face 68 (FIG. 7) on a plane perpendicular to the axes of insert body 64 and shank 14. Extending axially and integrally outwardly of shoulder 66 is a pin 69 having an externally threaded portion 70 adjacent to shoulder 66 and an unthreaded portion 72 of reduced diameter extending coaxially outwardly from threaded portion 70 so as to cooperate with the unthreaded portion 56 of the bore in insert 52 for guiding the respective threaded portions into assembly. The portion of pin 69 coupling threaded portion 70 to shoulder 66 is of reduced diameter for receiving any accumulated dirt while permitting abutting engagement of the respective insert faces 60, 68 in assembly. The surfaces of inserts 52, 62 press fitted into shaft 20 and shank 14 should be roughened as by spiral grooves 80 (FIGS. 5–7) or knurling for enhanced adhesion.

In the particular embodiment of the lock 50 in accordance with the invention illustrated in FIGS. 5–7, the direction of twist of inserts 62, 52 is left-hand for use with right-handed clubs. In use, a selected club head with attached shank is threaded onto shaft 20 of handle 16 in the left-hand direction until faces 60, 68 are in abutment. Faces 60, 68 thus operate to limit threaded insertion of pin 69 into insert 52. When the assembled club is then used, the impact of the club head against the ball will tend to rotate the shank 14 in the direction 76 in FIG. 5, which is the direction of tightening of shank 14 onto handle shaft 20. Thus, lock 50 is self-locking in use so as to permit maximium energy transfer from the club head to the ball. It will also be noted in accordance with the invention that the lock 50 occupies only a small portion of the overall length of the assembled handle 16 and club head 12 (FIG. 4) so that, in view of the self-locking feature previously described, the reduction in flexibility and strength of the overall club will be de minimis and recognizable, if at all, only by a professional. The assembled club may be readily disassembled after use by merely applying a reverse twist, specifically a right-hand twist in the embodiment of FIGS. 5–7, to the club head shank and handle shaft.

Although the invention has been described in connection with a specific presently preferred embodiment thereof, it will be appreciated that the invention is not limited to the specific details of the described embodiment. For example, the set of club heads shown in the drawing and previously described comprises a so-called short set having only odd numbered woods and irons. It will be evident, however, that the principles of the invention may be equally applied to a full club set having both odd and even woods and irons, in addition to various accessory clubs such as the five wood or sand wedge, etc. Indeed, the invention is particularly advantageous as applied to such expanded sets since the overall weight and bulk thereof will be greatly reduced as compared with sets of preassembled clubs. Similarly, for a club set of left-handed dexterity, the direction of twist of the threaded portions 54, 70 on inserts 52, 62 would be right-handed.

The invention claimed is:

1. A golf club set comprising a plurality of differing club heads with individually differing alphanumeric designations, each said club head having an attached shank of predetermined length extending from the associated club head, said predetermined lengths differing in correspondence with said differing alphanumeric designations of said club heads, a golf club handle of predetermined fixed length, means associated with each said club head and with said handle for releasably attaching each of said golf club heads individually to said golf club handle so as to form a golf club having a predetermined overall length which varies with said alphanumeric designations, a rectangular hollow carrying case having an open end, a zippered closure in one side wall of said case comprising a rectangular flap attached to said case along an edge remote from said open end and zipper means extending around the three remaining edges of said flap and around an opposing surface of said case, a rectangular one-piece insert of foam rubber construction received in and filling the interior of said hollow case with an insert surface adjacent to said open case end, said insert having a plurality of blind tubular openings extending from said surface on parallel spaced opening axes and a blind rectangular recess opening in alignment with said zippered closure for storage of accessories, said tubular openings being adapted to receive said head shanks one in each of said openings such that said club heads rest upon said surface in a spaced array corresponding to said opening array, a tubular holster mounted externally of said case and extending lengthwise along one side wall of said case parallel to said opening axes for removably receiving said handle, a cover including means for removably mounting said cover over said openings so as to protect said club heads while leaving said handle exposed, and an adjustable shoulder strap extending from said bag.

2. The golf club set forth in claim 1 wherein all of said club heads are adapted for use by persons of predetermined dexterity either right-handed or left-handed, and wherein said means includes threaded connection means fixedly mounted on said shanks and said shaft having a direction of thread twist opposite to said predetermined dexterity.

3. The golf club set forth in claim 2 wherein said handle includes a hollow shaft, and wherein said threaded means includes an internally threaded insert fixedly mounted internally of said shaft and a plurality of externally threaded inserts each fixedly mounted on a corresponding one of said shanks.

4. The golf club set set forth in claim 3 wherein each said externally threaded inserts includes a threaded portion adjacent the corresponding shank and a coaxial unthreaded portion of reduced diameter extending from said threaded portion, and wherein said internally threaded insert includes an internal passage having a threaded portion adjacent the end of said shaft and an unthreaded portion of reduced diameter extending coaxially from said threaded portion, said unthreaded portions of said inserts operating to align said threaded portions in assembly of a selected said club head to said handle.

5. The golf club set set forth in claim 4 wherein said inserts include integral shoulders having plane surfaces for opposed facing engagement to limit threaded insertion of said externally threaded insert into said internally threaded insert.

6. The golf club set set forth in claim 5 wherein each of said externally threaded inserts further includes a second unthreaded portion of reduced diameter extending between said threaded portion and said plane surface on each said insert for receiving any accumulated dirt while permitting said opposed facing engagement.

* * * * *